US010329053B2

(12) United States Patent
Steele

(10) Patent No.: US 10,329,053 B2
(45) Date of Patent: Jun. 25, 2019

(54) PACKAGE HAVING A FILL AND SEAL FEATURE

(71) Applicant: Mark Steele, New Prague, MN (US)

(72) Inventor: Mark Steele, New Prague, MN (US)

( * ) Notice: Subject to any disclaimer, the term of this patent is extended or adjusted under 35 U.S.C. 154(b) by 562 days.

(21) Appl. No.: 14/925,900

(22) Filed: Oct. 28, 2015

(65) Prior Publication Data

US 2016/0046409 A1 Feb. 18, 2016

Related U.S. Application Data

(63) Continuation of application No. 12/973,356, filed on Dec. 20, 2010, now abandoned.

(60) Provisional application No. 61/287,778, filed on Dec. 18, 2009.

(51) Int. Cl.
*B65B 61/18* (2006.01)
*B65D 30/20* (2006.01)
*B65D 30/24* (2006.01)

(52) U.S. Cl.
CPC ..... *B65D 31/147* (2013.01); *B65B 61/18* (2013.01); *B65D 31/10* (2013.01)

(58) Field of Classification Search
CPC ..... B65B 61/188
USPC ..... 53/412
See application file for complete search history.

(56) References Cited

U.S. PATENT DOCUMENTS 5,826,401 A * 10/1998 Bois ..... B65B 9/20 53/412
7,553,083 B2 * 6/2009 Plourde ..... B65B 9/20 383/203
2010/0002964 A1 * 1/2010 Yeager ..... B65D 33/1691 383/204

* cited by examiner

*Primary Examiner* — Lori L Baker
(74) *Attorney, Agent, or Firm* — Skaar Ulbrich Macari, P.A.

(57) ABSTRACT

A flexible package having a fill opening or feature can be included in one or more of the package panels, with an internal fill patch provided proximate or about the fill opening. The patch can be initially sealed at one or more edge or portions to the internal surface of the respective package panel or panels, with a generally free edge or portion remaining unsealed until the package is filled with material contents.

20 Claims, 5 Drawing Sheets

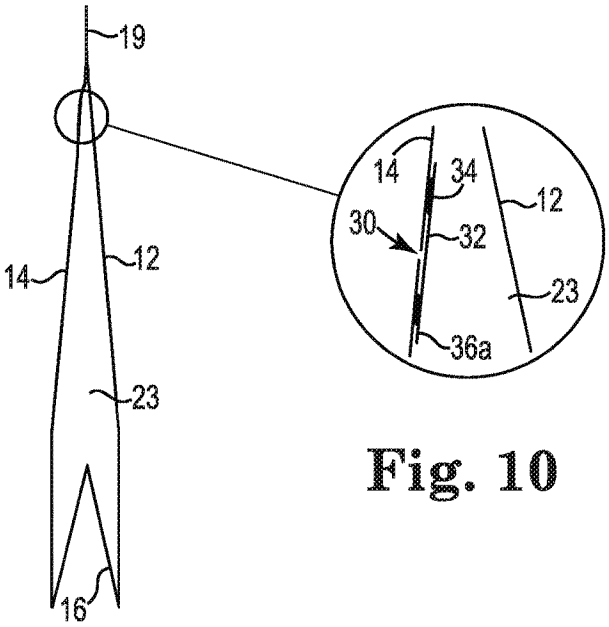
Fig. 9
Fig. 10
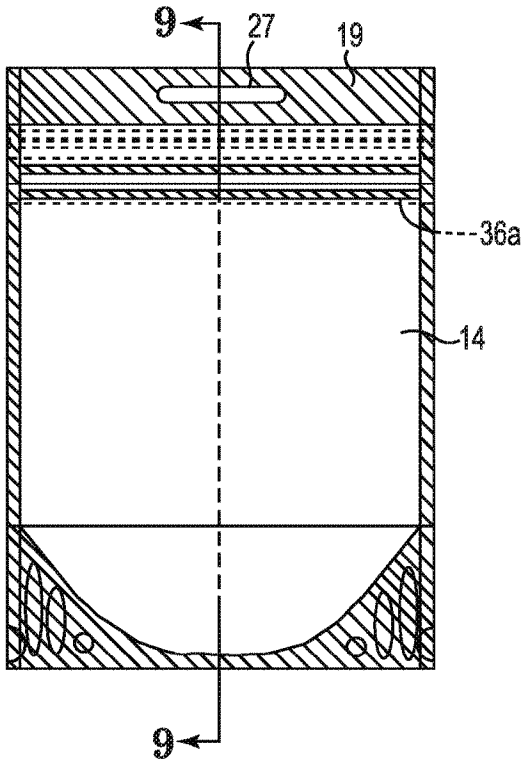
Fig. 8

PACKAGE HAVING A FILL AND SEAL FEATURE

PRIORITY

This application is a continuation of U.S. application Ser. No. 12/973,356, filed Dec. 20, 2010, which claims priority to and the benefit of U.S. Provisional Application No. 61/287,778, filed Dec. 18, 2009; each of these applications and disclosures hereby fully incorporated herein by reference.

FIELD OF THE INVENTION

The present invention relates generally to flexible packaging and, more particularly, to flexible packaging having at least one fill feature provided therewith.

BACKGROUND OF THE INVENTION

Conventional flexible packaging having side gussets have grown in usage. These side gusseted packages can include re-closeable devices (e.g., zippers), handles, and miter seals or K-seals with tacked corners. However, incorporation of these desirable features with such packages can create problems.

In particular, the ability to fill and seal such packages in a pre-made pouch or package configuration can be limited by their construct and features. For instance, the side gussets on the packages, when tucked in for the final or final end seal, can create thickness variations or additional steps due to the construct of two or more layers of the relevant portion of the package requiring sealing (e.g., combinations of the front and back panels, main and gussets panels or webs, etc.).

Because these multiple film layers can make it difficult to provide an air tight seal, leaking, contamination and like undesirable issues may arise with the packages upon final sealing. Moreover, it can be difficult to tuck the side gussets of such packages evenly once the packages are filled with product, which may further make it difficult to get an acceptable leak-proof seal after filling the package with contents or product.

Still further, the side gussets of such packages may also create sealing challenges because the heat-seal threshold for sealing through the multiple layers of material or film may vary significantly from the remaining package portions, or may require a level of heat that mandates the use of additional or specialized sealing equipment or steps.

These special steps and equipment may be especially problematic for customers or fillers receiving "pre-made" packages, whereby the customer is set up to simply fill the package with product or contents and provide the final package seals after filling is complete. Such customers are likely ill-equipped to provide the desired sealing in view of the unique construct of these packages. For instance, when a customer or filler receives such conventional pre-made side gusseted packages with zippers or other re-closeable devices or features, they must open and fill through the devices, and then seal the top of the package above the device. As such, the sealing and material challenges described above can present a problem. Alternatively, the pre-made package can be provided to the filler or customer with a flange of the device (e.g., zipper) unattached such that the package can be filled from behind the device. However, the unattached zipper must be sealed or attached after filling, again presenting the problems and challenges detailed above.

In addition, various side gusseted pre-made packages can include handles cut therein (e.g., die-cut), whereby the area around the handle must be sealed to prevent leakage. The seals required around these cut-out handle portions can require significantly wider sealing equipment or apparatus to seal the larger area. Many conventional sealing and filling machines do not have the equipment to accomplish such seals.

In addition to the above-detailed problems presented with final filling and sealing of desirable pre-made side gusset packages, various miter seals, K-seals, and the like are often avoided despite their benefits. Namely, many of these sealing features can assist in preventing product from getting into the deep corners of the package and providing a desirable and often stronger seal between the front and back panels, but are often avoided because they hinder access to the opening or width for filling, and therefore slow down the filling process. They also require wider or more sealing surface areas than commonly found on filling and sealing machines.

As a result, there is a need for a package design and method of formation that will allow for the many beneficial features and package constructs described above while still providing a package that is easily fillable and sealable.

SUMMARY OF THE INVENTION

The present invention solves many of the problems that plague conventional flexible packages and packaging methods. Various embodiments of the present invention are directed to a package having a fill slit or fill feature extending from the first longitudinal edge to the second longitudinal edge of a panel of the package (e.g., front or back panel). The package can be a pre-made side gusseted package, wherein the fill slit or feature is provided generally parallel to the top edge or final top seal of the package, in either machine direction or transverse to machine direction. Providing the pre-made package with a top or other seals already formed allows the package former or manufacturer to include various desirable seals, handles, re-closeable devices, multiple panels, and other features in the package, while still allowing for a filling opening for the customer or package filler. The fill slit or feature can be provided nearly anywhere on the package. In one embodiment, the fill slit or feature can be provided just below a re-closeable device, such as a zipper, with a patch of material added to the inside of the package.

The patch can extend a width generally greater than the width of the fill slit or feature on the inside of the package, with at least a top edge or portion of the patch being sealed to the inside of the package above the slit or feature. As such, the patch can include a free end that is not sealed (at least initially) to the inside of the package, extending generally below the fill slit or feature. The patch can be constructed of any compatible polymer or like material. In one embodiment, the patch can be constructed of a laminate material adapted to only seal on one side upon application of heat, such that at least one side has a non-sealable barrier film (e.g., preventing it from sealing to an opposing interior panel surface of the package, and providing a oxygen and/or moisture barrier at the fill slit). In certain embodiments, the patch can be included with or defined as part of an access device, e.g., flange portions of a zipper, re-closeable device, or the like.

The filler or customer receiving the package in accordance with features of the present invention can open the package to the full width of the fill slit and fill the package with product or contents, even past or above the fill slit. Then, the filler can easily seal the package closed by sealing the slitted panel to the patch or patch material below the fill slit or feature. As such, only one layer or material needs to be sealed, making filling and sealing simpler, easier and more cost effective, while still retaining desired seal features, handles, re-closeable device, and the like, for the package.

The features of the present invention can be employed in a myriad of packages, including form-fill-and-seal packages, pre-made packages, stand-up packages, side access packages, top access packages, front and back access packages, and any other package configurations and designs known to those of ordinary skill in the art.

BRIEF DESCRIPTION OF THE DRAWINGS

FIG. 8 shows a package having a fill opening, internal fill patch and bottom gusseted panel, in accordance with embodiments of the present invention.

FIG. 9 is a side cross-sectional schematic view of the package at line 9-9 of FIG. 8.

FIG. 10 is a close-up partial schematic view of a portion of the package of FIG. 9, with the fill patch finally sealed off at a bottom edge portion.

Figure 3:
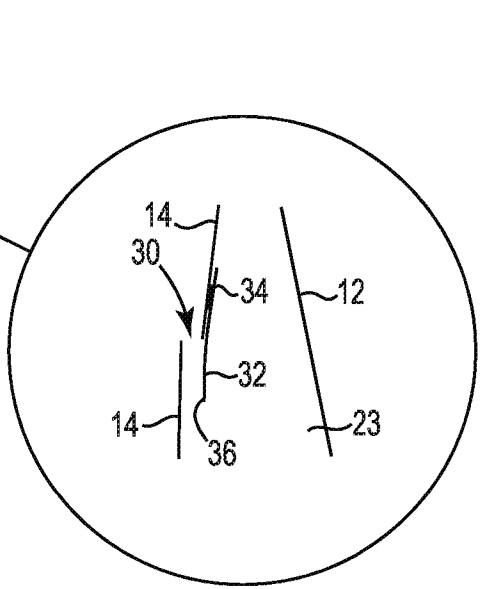
FIG. 3 is a close-up partial schematic view of a portion of the package of FIG. 2.

While the invention is amenable to various modifications and alternative forms, specifics thereof have been shown by way of example in the drawings and will be described in detail. It should be understood, however, that the intention is not to limit the invention to the particular embodiments described. On the contrary, the invention is to cover all modifications, equivalents, and alternatives falling within the spirit and scope of the invention as defined by the appended claims. For illustrative purposes, hatching or shading in the figures is generally provided to demonstrate sealed portions and/or integrated devices for the package. In addition, the size and proportions of seal or other portions may be exaggerated with respect to the surrounding material and films to improve visual depictions.

DETAILED DESCRIPTION OF PREFERRED EMBODIMENTS

Figure 2:
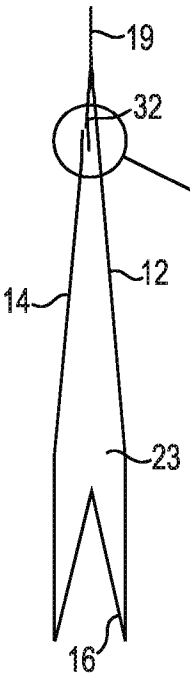
FIG. 2 is a side cross-sectional schematic view of the package at line 2-2 of FIG. 1.
Figure 1:
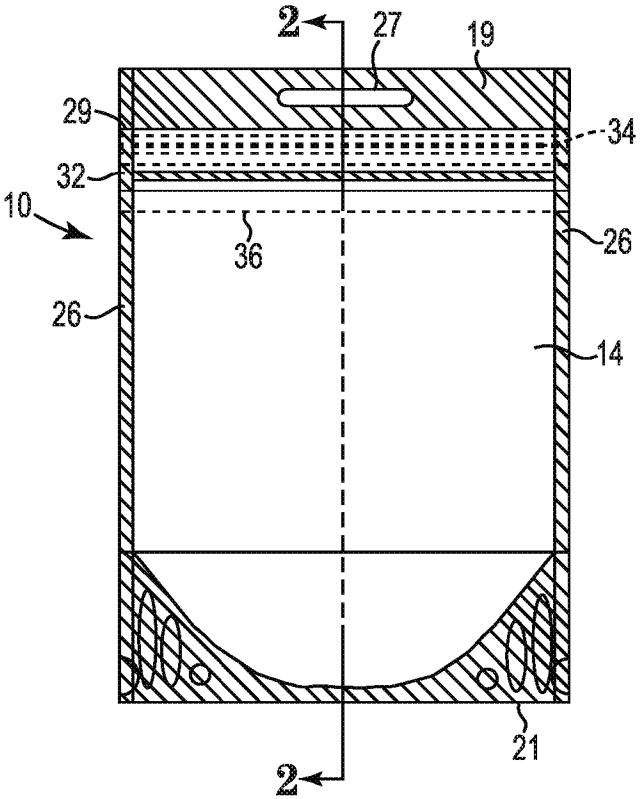
FIG. 1 shows a package having a fill opening and internal fill patch in accordance with embodiments of the present invention.
Figure 4:
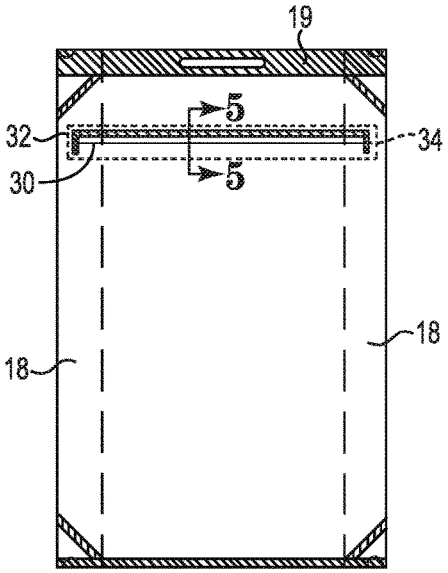
FIG. 4 shows a package having a fill opening and internal fill patch, in accordance with embodiments of the present invention.
Figure 6:
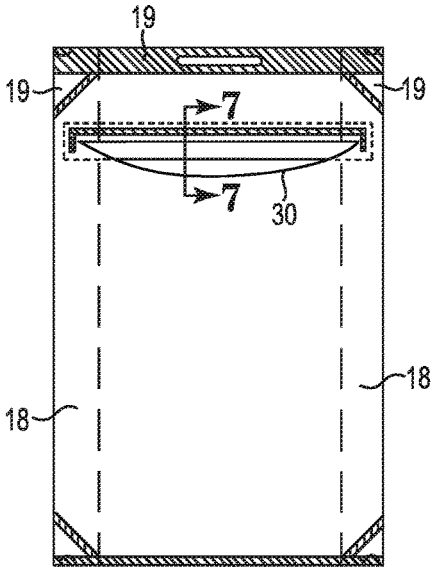
FIG. 6 shows a package having a fill opening and internal fill patch, with the package being filled with product or material contents, in accordance with embodiments of the present invention.
Figure 5:
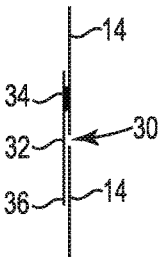
FIG. 5 is a side cross-sectional schematic view of a portion of the package at line 5-5 of FIG. 4.

Referring generally to FIGS. 1-13, a flexible package 10 in accordance with the present invention, and the steps for forming, using and filling the flexible package 10, are shown. The package 10 generally includes a front panel portion 12, a back panel portion 14 and one or more side panel portions 18. The package can further include a bottom panel portion 16. Any of the panel portions can be gusseted, e.g., the side panel portions 18 (FIG. 13) and bottom panel portion 16 (FIGS. 2, 9). Panel portions 12-18 can be joined to form or define an inner cavity 23 of the main package 10 for holding, transporting, or otherwise containing material contents. Each of the panel portions can include internal sealant surfaces. The joining of the front and back panels 12, 14 can create corresponding side or seal edges 26, and top 19 and bottom 21 seals. Alternatively, the panels can be formed of a single web material and folded or formed to define the distinct panel portions. The cross-hatching in the figures is generally used to denote sealing and/or panel edges or folds. Various handles or handle portions 27 as well as re-closeable device 29 or other features or structures can be included anywhere on the package 10 or package panels 12-18.

The package panel portions are generally constructed of flexible sheet material such as polyethylene, polyester, metal foil, polypropylene, or polyethylenes or polypropylenes laminated with other materials such as nylon, polyester, and like films. To provide for higher barriers, embodiments can use combination layers of said materials and material of the like. In addition, various panel portions can be constructed of, or incorporated with, materials that provide preferred sealing characteristics. One skilled in the art will understand that a myriad of materials and material laminates are available for selective use for the sealant surfaces to facilitate the bonding attachment described herein. In one embodiment, at least one of the sealant surfaces will comprise "contaminants" that permit a varying level of bonding, wherein the level of bondable attachment depends on the heat applied from a corresponding heat sealing bar or other device. Higher temperatures will create "destructive" (e.g., permanent) bonds while lower temperatures will create a more temporary bond for selective disengagement. Seal pressures and dwells can also affect the bond level.

In one embodiment, as depicted in FIGS. 1-7, the package 10 includes a fill opening, slit or feature 30 defined in at least one of the panel portions, such as the back panel 14. The fill opening 30 (and the patch 32 described herein) can be provided in any of the panels and can extend past the panel portion 14 and into the side panels 18, or any edges/seals of the package 10 (continuous, transverse, machine direction, etc.). In certain embodiments, the fill opening 30 can be covered by a removable material, can be defined by a perforation or scoring in the package panel, or can take on any other configuration adapted to define or selectively provide an opening for filling the package 10 or cavity 23 with material contents.

A patch 32, or other strip or material, can be provided inside the package, with the patch 32 having one or more seal edges or portions 34 and a generally free edge or portion 36. The patch can be constructed of any compatible polymer or like material, can be formed in any shape or size, and can include various textures, materials, ribs, structures or like features to facilitate sealing and attachment. In one embodiment, the patch can be constructed of a laminate material adapted to only seal on one side upon application of heat, such that at least one side has a non-sealable barrier film configuration (e.g., preventing it from sealing to an opposing interior panel surface of the package—such as front panel 12). The patch 32 and its edge portions 34, 36 can be included with or defined from flanges or other features of an access device, such as a zipper device, re-closeable device, peel seal material, and the like.

The one or more seal edges 34 are adapted for sealing to the inside surface of the corresponding panel portion (e.g., back panel 14) proximate the fill opening 30 by the package former or manufacturer, with the free edge 36 remaining initially unsealed to provide an internal flap about the fill opening 30. While the patch 32 is depicted in various figures for internal attachment or sealing to the back panel portion 14 and across to the side panel portions 18, the patch 32 can be defined in any of the panel portions 12-18, or combinations thereof. Further, the patch 32 can be applied to the outer surface or portion of a panel, or panels, and can be sealed using various known techniques, such as heat, adhesive, bonding, etc.

Figure 7:
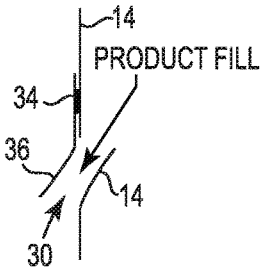
FIG. 7 is a side cross-sectional schematic view of a portion of the package at line 7-7 of FIG. 6.
Figure 11:
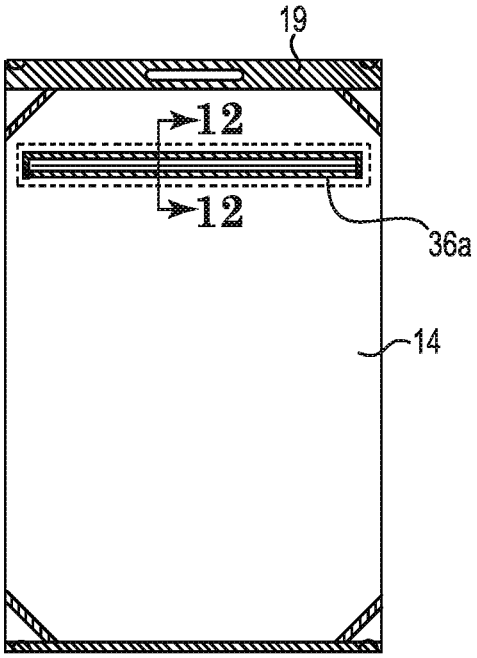
FIG. 11 shows a package having a fill opening and sealed fill patch in accordance with embodiments of the present invention.

As depicted in FIGS. 4-7, the filling opening or slit 30 in the respective package panel can be manipulated to provide an opening to fill the internal cavity 23 of the package 10 with material contents. As such, the free edge 36 of the patch 32 is configured to permit the contents to enter the internal cavity 23 (FIG. 7). The filler or customer receiving the package 10 in accordance with features of the present invention can open the package 10 to the full width of the fill opening 30 and fill the package 10 with product or contents, generally below the fill opening 30. However, filling could extend even past or above the fill opening 30.

Upon filling the internal cavity 23 of the package 10 with the desired amount of contents, as shown in FIGS. 8-11, the fill opening 30 can be closed off by providing a seal 36*a* to the free edge 36 such that the patch 32 is completely sealed at its edges to the internal surface of the package panel. The seal 36*a* can be applied, as with any of the seals shown or disclosed herein, with a seal bar, band sealer or other equipment or techniques known to one of ordinary skill in the art. Such a configuration means that the filler or customer needs to only seal one layer or material to close off the opening 30 and package 10, making filling and sealing simpler, easier and more cost effective, while still retaining desired seal features, handles, re-closeable device, and the like, for the package 10. As shown in the figures, various seals (K-seals, miter seals, top seals, bottom seals, side seals, etc.), handles, re-closeable devices and other features or structures can be finalized and provided by the original package former or manufacturer without generally effecting the ability of the package filler to fill and close off the package 10.

Figure 12:
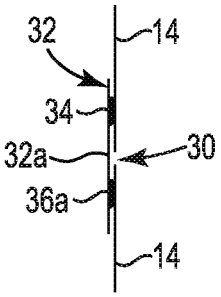
FIG. 12 is a cross-sectional schematic view of a portion of the package at line 12-12 of FIG. 11.
Figure 13:
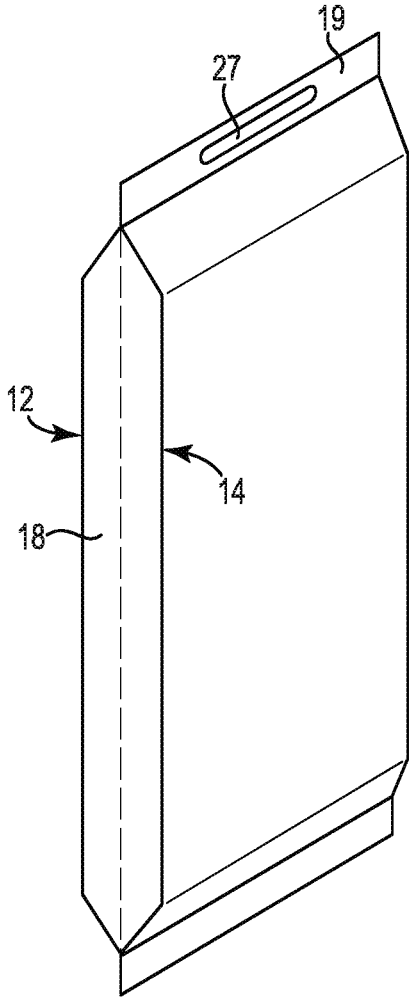
FIG. 13 is perspective view of a side gusseted package in accordance with embodiments of the present invention.

A portion of the patch 32 can include a weakened portion 32*a*, such as a perforation, score or other like construct or feature to allow a user or customer to break through, breach or otherwise gain access to the internal cavity contents via the patch 32 even after the patch 32 is sealed (e.g., FIG. 12). In such an embodiment, the slit opening 30 can be accessed (e.g., via an opening, access device, zipper, etc.) and the user can push through or otherwise breach the weakened feature of the patch 32 to facilitate communication from the interior cavity out through the slit opening 30. As such, contents can later be accessed or dispensed through the slit opening even after sealing of the free edge 36 at seal 36*a*.

In various embodiments, the patch 32 can be included with or can be defined by a zipper or other access device (e.g., re-closeable access device). For instance, the patch portions 34, 36 can be defined as extending flange or other portions of an access device, such that a first flange portion 34 is sealed on a first side of the slit 30 and the other flange portion provides the free edge portion 36 for later sealing to the interior of the panel portion 14 on a second side of the slit 30.

Various graphics, closeable and re-closeable devices, gussets and like features known to one skilled in the art are also envisioned for use with this invention and can be implemented without deviating from the spirit and scope of the present invention. All references to front, back, top, bottom, and the like are merely for demonstrative purposes and are not intended to limit the variations and positional references and orientations of the panels in the present invention.

Various embodiments can further include slits, scores, cuts, removable slugs, perforations, notches, and the like in the package 10 or package panels 12-18 to provide or define the features described herein. Other peel-back materials, tabs, or tear portions, can be located proximate the fill opening 30 to facilitate selective access to the package or panels.

The present invention may be embodied in other specific forms without departing from the spirit or essential attributes thereof, and it is, therefore, desired that the present embodiment be considered in all respects as illustrative and not restrictive. Similarly, the above-described methods and techniques for forming the present invention are illustrative processes and are not intended to limit the methods of manufacturing/forming the present invention to those specifically defined herein. A myriad of various unspecified steps and procedures can be performed to create or form the inventive package 10.

What is claimed is:

1. A method of package formation and filling, comprising:

providing a package having a first panel portion and a second panel portion, at least the first panel portion and the second panel portion sealed along first and second side seals and defining an interior package cavity adapted to hold material contents;

providing a fill slit opening defined in a portion of the first panel portion;

providing a unitary fill strip having a first longitudinal edge portion, a longitudinal free end portion, and first and second ends transverse to at least the first longitudinal edge portion, the first longitudinal edge portion sealed to an interior surface of the first panel proximate a first side of the slit opening, the first and second ends sealed to the first and second side seals such that a portion of the unitary fill strip intermediate the first and second side seals does not seal to an interior surface of the second panel portion;

filling at least a portion of the interior package cavity with material contents via the fill slit opening, past the free end portion; and sealing the free end portion to the interior surface of the first panel proximate a second side of the fill slit opening within the interior package cavity, after filing the interior package cavity with the material contents.

2. The method of claim 1, further including providing a bottom panel portion.

3. The method of claim 1, further including providing at least one side panel portion.

4. The method of claim 1, wherein the longitudinal free end portion is sealed to the interior surface of the first panel with a temporary seal.

5. The method of claim 1, wherein the fill slit opening generally extends from the first side seal to the second side seal.

6. The method of claim 1, wherein the slit opening includes a perforation line in the first panel portion.

7. The method of claim 1, further including removing a top seal to access the material contents.

8. The method of claim 1, wherein the first panel portion is a back panel portion of the package.

9. The method of claim 1, wherein the first panel portion is a front panel portion of the package.

10. The method of claim 1, further including a gusseted panel portion.

11. The method of claim 1, further including providing an access device to facilitate access into the interior cavity of the package.

12. The method of claim 11, wherein the access device is provided intermediate the fill slit opening and atop seal.

13. The method of claim 1, wherein the fill patch includes a weakened portion to facilitate access into the interior cavity of the package.

14. The method of claim 1, wherein the free end portion is sealed to the interior surface of the first panel with a destructive seal.

15. A method of package formation and filling, comprising:

providing a package having a first panel portion and a second panel portion, at least the first panel portion and the second panel portion having opposing longitudinal side edges, and defining an interior package cavity adapted to hold material contents;

providing a fill slit opening defined in a portion of the first panel portion;

providing an access device to the first panel portion;

providing a unitary fill patch having a longitudinal first edge portion, a longitudinal free end portion, and first and second edge portions transverse to the first edge portion, the first edge portion sealed to an interior surface of the first panel proximate a first side of the slit opening;

sealing the first and second end portions to the opposing longitudinal side edges such that a portion of the fill patch intermediate the longitudinal side edges does not seal to an interior surface of the second panel portion;

filling at least a portion of the interior package cavity with material contents via the fill slit opening; and sealing the free end portion proximate a second side of the fill slit opening within the interior package cavity to close off the fill slit opening.

16. The method of claim 15, wherein the free end portion is sealed to the interior surface of the first panel with a temporary seal.

17. The method of claim 15, wherein the slit opening includes a perforation line in the first panel portion.

18. The method of claim 15, further including accessing the material contents via the access device.

19. The method of claim 15, wherein the fill patch includes a weakened portion to facilitate access into the interior cavity of the package.

20. The method of claim 15, wherein the free end portion is sealed to the interior surface of the first panel with a destructive seal.

* * * * *